US006370914B1

(12) United States Patent
Bruner

(10) Patent No.: US 6,370,914 B1
(45) Date of Patent: Apr. 16, 2002

(54) OPENABLE RING WITH COOPERATING TONGUE AND GROOVE MEMBERS

(76) Inventor: Mates A. Bruner, 14 Barbara La., Havertown, PA (US) 19083

( * ) Notice: Subject to any disclaimer, the term of this patent is extended or adjusted under 35 U.S.C. 154(b) by 0 days.

(21) Appl. No.: 09/459,794

(22) Filed: Dec. 13, 1999

(51) Int. Cl.[7] ..... A44C 19/00

(52) U.S. Cl. ..... 63/15.7; 63/15; 63/15.5

(58) Field of Search ..... 63/15, 15.45, 15.5, 63/15.65, 15.7; 24/598.2, 20 TT

(56) References Cited

U.S. PATENT DOCUMENTS

| | | | | | |
|---|---|---|---|---|---|
| 145,788 | A | | 12/1873 | Cottle | |
| 804,137 | A | | 11/1905 | Kent | |
| 812,458 | A | * | 2/1906 | See | 70/458 |
| 1,003,696 | A | | 9/1911 | Briggs | |
| 1,296,435 | A | | 3/1919 | Schmidt | |
| 2,045,282 | A | | 6/1936 | Metcalf | 63/7 |
| 3,204,426 | A | | 9/1965 | Armstrong | 63/15.5 |
| 3,221,514 | A | | 12/1965 | Newman | 63/15.7 |
| 3,465,543 | A | | 9/1969 | Baker | 63/15.5 |
| 3,736,770 | A | | 6/1973 | Kelrick | 63/15.7 |
| 4,183,120 | A | * | 1/1980 | Thorne | 24/16 R |
| 4,763,490 | A | * | 8/1988 | Bruner | 63/15.7 |
| 4,879,883 | A | | 11/1989 | Bruner | 63/15.7 |
| 4,991,409 | A | * | 2/1991 | Creates | 63/15.7 |
| 5,136,858 | A | | 8/1992 | Bruner | 63/15.7 |

FOREIGN PATENT DOCUMENTS

| | | |
|---|---|---|
| FR | 2303498 | 3/1975 |
| NL | 87327 | 1/1958 |

* cited by examiner

*Primary Examiner*—B. Dayoan
*Assistant Examiner*—Andrea Chop
(74) *Attorney, Agent, or Firm*—Caesar, Rivise, Bernstein, Cohen & Pokotilow, Ltd.

(57) ABSTRACT

An openable ring that is arranged to be worn about a portion of a body of a person and that requires a minimal amount of force to close. The ring includes first and second arcuate sections that are pivotally interconnected at one end of the ring for permitting pivotal movement of the arcuate sections between opened and closed positions. At the end opposite the pivotal interconnection, each arcuate section includes a pair of locking extensions. The locking extensions each include male and female connecting sections and cooperate with each other to releasably retain the arcuate sections in a closed position to define a closed ring having an inner surface and an outer surface. The inner surface defines an interior passage for receiving a portion of the person's body, e.g., a finger.

11 Claims, 2 Drawing Sheets

OPENABLE RING WITH COOPERATING TONGUE AND GROOVE MEMBERS

BACKGROUND OF THE INVENTION

This invention relates generally to ring-like objects designed to be worn as jewelry, and more particularly to rings which are enabled to be releasably opened for fitting about a portion of the wearer's body, e.g., finger, which are resistant to accidental opening, and which are easily opened when desired.

Conventional finger rings or other jewelry arranged to be worn about a portion of the body must have a sufficient diameter to slide over the knuckle or other bony protuberance adjacent the point at which the ring is to be worn. Normally, such action does not present any problem since the difference in diameter between the bony protuberance, e.g., knuckle, and the portion on which the ring is worn is sufficiently small so that a properly fitting ring is comfortable to wear, to put on and to remove. However, there are numerous individuals who, for a variety of reasons, such as bone fractures, arthritis, etc., have enlarged knuckles or other protuberances, which prevent their wearing of conventional jewelry.

The prior art includes adjustable, expandable and openable jewelry rings. For example, some of the prior art discloses rings which are adjustable in size through a specific range. Such rings are limited to a fixed expansion and are adapted to permanently remain in one particular size. They are also generally constructed so that they can expand only to a limited degree, thus limiting the size of a knuckle or other protuberance over which they may be fit.

The prior art also discloses openable rings having exposed latching members that easily can be opened by a person's finger, to thereby permit repeated opening of the ring. Because these rings have exposed latching members that are designed to be opened by the modest downward force imparted by a person's finger, they inherently lack the desired durability and safety against self-opening.

There are a variety of other openable ring constructions which have been disclosed in the prior art. A number of the ring constructions employ, as part of the locking or latching system, a separate spring member. The use of a separate spring can increase the fabrication and material costs of the ring, since the spring element is made separate from the ring, and then needs to be affixed to the remainder of the ring structure. In addition, resilient spring members often tend to lose their resiliency, and in prior art constructions employing such spring members, a loss of resiliency may adversely affect the locking capabilities of the construction.

In a variety of prior art structures the latching mechanisms are quite bulky and unsightly, and therefore are not readily adaptable for use on high quality jewelry made of precious metals, such as gold and platinum. Still other latching assemblies constitute a point of weakness which is readily susceptible to being deformed under bending stresses of the type which normally are encountered by the wearer of the ring. Still other prior art structures are somewhat difficult to use, requiring substantial manual dexterity in order to properly close the ring, and, when desired, to open the ring.

Examples of prior art adjustable or openable ring-like jewelry are found in Netherlands Patent No. 87,327 (Goldbach); French Patent No. 75 07499 (Algier); and the following U.S. Pat. No. 145,788 (Cottle); U.S. Pat. No. 804,137 (Kent); U.S. Pat. No. 1,003,696 (Briggs); U.S. Pat No. 1,296,435 (Schmidt); U.S. Pat. No. 2,045,282 (Metcalf); U.S. Pat. No. 3,204,426 (Armstrong); U.S. Pat. No. 3,221, 514 (Newman); U.S. Pat. No. 3,465,543 (Baker); U.S. Pat. No. 3,736,770 (Kelrick) and U.S. Pat. No. 4,879,883 (Bruner).

In U.S. Pat. No. 5,136,858, (Bruner), which is hereinafter referred to as the '858 patent and of which I am the sole inventor, and the disclosure of which is incorporated herein by reference, there is disclosed and claimed an openable ring which overcomes many of the drawbacks of the prior art openable rings. In particular, the openable ring of the '858 patent includes first and second arcuate sections pivotally interconnected at one end for permitting pivotal movement of the arcuate sections between opened and closed positions. Latching members are included on each arcuate section. The latching members on one arcuate section include an elongate tongue and a pair of locking extensions located on opposite sides of the tongue, each locking extension including male and female connecting sections. The latch members on the other arcuate section include a pair of locking extensions located on opposite sides of a central bridge section, and these locking extensions include male and female connecting sections for engaging with the male and female connecting sections of the one arcuate section. The other arcuate section includes a safety latch which automatically is pivoted into an overlapping position with a raised projection on the tongue when the ring is moved into a closed position, with a section of the tongue underlying both the bridge section and the safety latch, and with the locking extensions on the one arcuate section engaging the corresponding locking extensions on the other arcuate sections.

One advantage the '858 openable ring has over the prior art is that it is not susceptible to inadvertent opening. Another advantage the openable ring of the '858 patent has over the prior art is that it does not rely upon external spring elements to provide a locking function. A third advantage the openable ring of the '858 patent has over the prior art is that it relies upon the inherent spring tension of the material of the ring to assist in maintaining the ring in a closed, or latched condition. Further, the openable ring of the '858 patent is constructed to provide an aesthetically pleasing appearance, without any unsightly bulging and/or projecting elements.

While the openable ring of the '858 patent overcomes many of the disadvantages of the prior art, it nevertheless still leaves something to be desired from at least one standpoint. For example, under the openable ring construction of the '858 patent, where the width and thickness of the ring is relatively small, e.g., approximately 2.0 millimeters in thickness and 2.5 millimeters wide, only a small amount of force is required to move the ring to the closed position. However, where the thickness of the ring is somewhat greater and the width up to 10 millimeters, a great deal more force is required to engage the locking extensions on the one arcuate section with the locking extensions on the other arcuate section. Thus, openable rings constructed in accordance with the '858 patent and having somewhat greater thicknesses may be considerably more difficult to close.

OBJECTS OF THE INVENTION

Accordingly, it is a general object of this invention to provide an openable ring construction which is reliable in operation and easy to use.

It is a more specific object of this invention to provide an openable ring construction which overcomes the disadvantages of the prior art.

It is a more specific object of this invention to provide an openable ring construction that is inexpensive to manufacture.

It is a more specific object of this invention to provide an openable ring construction that is simple in construction.

Accordingly, it is a general object of this invention to provide an openable ring construction that can be provided in greater thicknesses while having the ability to be closed without excessive force.

It is a more specific object of this invention to provide an openable ring construction having a safety latch construction which is not susceptible to inadvertent opening.

It is a further object of this invention to provide an openable ring construction including a safety latch mechanism designed to release under a pulling force or pressure, to prevent serious injury to the wearer's finger.

It is a further object of this invention to provide an openable ring construction which is resistant to deformation by bending stresses.

It is a further object of this invention to provide an openable ring structure which does not rely upon external spring elements to provide a locking function.

It is a further object of this invention to provide a ring construction which relies upon the inherent spring tension of the material of the ring to assist in maintaining the ring in a closed, or latched condition.

It is a further object of this invention to provide an openable ring structure which has an aesthetically pleasing appearance, without any unsightly bulging and/or projecting elements.

SUMMARY OF THE INVENTION

These and other objects of this invention are achieved by providing an openable ring that is arranged to be worn about a portion of a body of a person and that requires a minimal amount of force to close. The ring includes first and second arcuate sections that are pivotally interconnected at one end of the ring for permitting pivotal movement of the arcuate sections between opened and closed positions. At the end opposite the pivotal interconnection, each arcuate section includes a pair of locking extensions. The locking extensions cooperate with each other to releasably retain the arcuate sections in a closed position to define a closed ring having an inner surface and an outer surface. The inner surface defines an interior passage for receiving a portion of the person's body, e.g., a finger. Each locking extension on the first arcuate section is transversely aligned with a respective locking extension on the second arcuate section. Each locking extension on the first arcuate section also includes male and female connecting sections. Each male connecting section on the first arcuate section includes a flat ramp section facing towards the outer surface of the ring. Each locking extension on the second arcuate section also includes male and female connecting sections. In response to movement of the arcuate sections towards the closed position, the male connecting section of the second arcuate section rides up the inclined ramp section and over the male connecting section of the first arcuate section thus causing the male connecting sections of each of the locking extensions to flex in a gradual manner into interlocking engagement with the female connecting sections thus requiring a minimal amount of force to close where the ring is greater in thickness.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
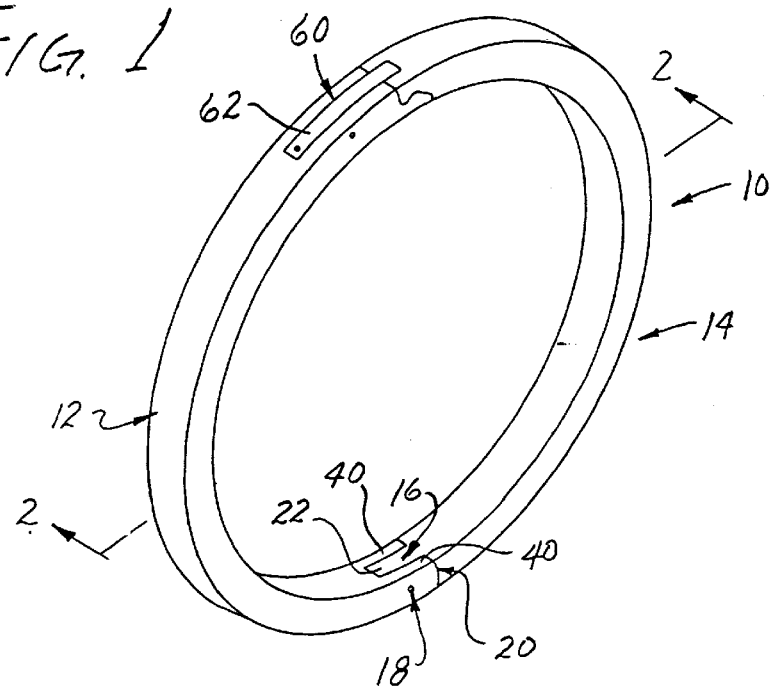
FIG. 1 is an isometric view of the ring of this invention in its closed position.

Referring now to the various figures of the drawing wherein like reference characters refer to like parts, an openable ring with a latch mechanism is generally shown at 10 in FIG. 1. The device 10 basically comprises a pair of arcuate sections 12 and 14 pivotally interconnected through a hinge connection 16 adjacent one of their contiguous ends, and including a latch mechanism 60 adjacent their opposite contiguous ends.

Referring again to FIGS. 1 and 2, the hinge connection 16 includes a hinge pin 18 extending through aligned openings in yolk 20 of section 12 and tang 22 of section 14. At this point it should be noted that the ring sections 12 and 14 are preferably made of a precious metal, i.e., gold, and are formed from wax impressions of the ring sections in a conventional investment casting operation. Yoke 20 also includes leg sections 40. The details of the construction and operation of the hinge connection are set forth in detail in U.S. Pat. No. 5,136,858, which is incorporated herein by reference.

It should be noted that, in the preferred use of the ring 10, the arcuate section 14 constitutes the upper section of the ring, and the arcuate section 12 constitutes the bottom section of the ring. Thus, the hinge connection 16 and the latch mechanism 60 are located in a plane which generally passes through the wearer's fingers (e.g., in a plane substantially perpendicular to the front and back surfaces of the wearer's hand).

In the preferred embodiment of the invention the pivot pin 18 is riveted to the arcuate sections 12 and 14, by employing riveting rolls of the type manufactured by the Grant Manufacturing and Machine Company of Bridgeport, Conn. The use of these riveting rolls provides a non-obtrusive appearing, rigid connection which is particularly important in the formation of high quality rings made from gold and/or other precious metals.

Figure 2:
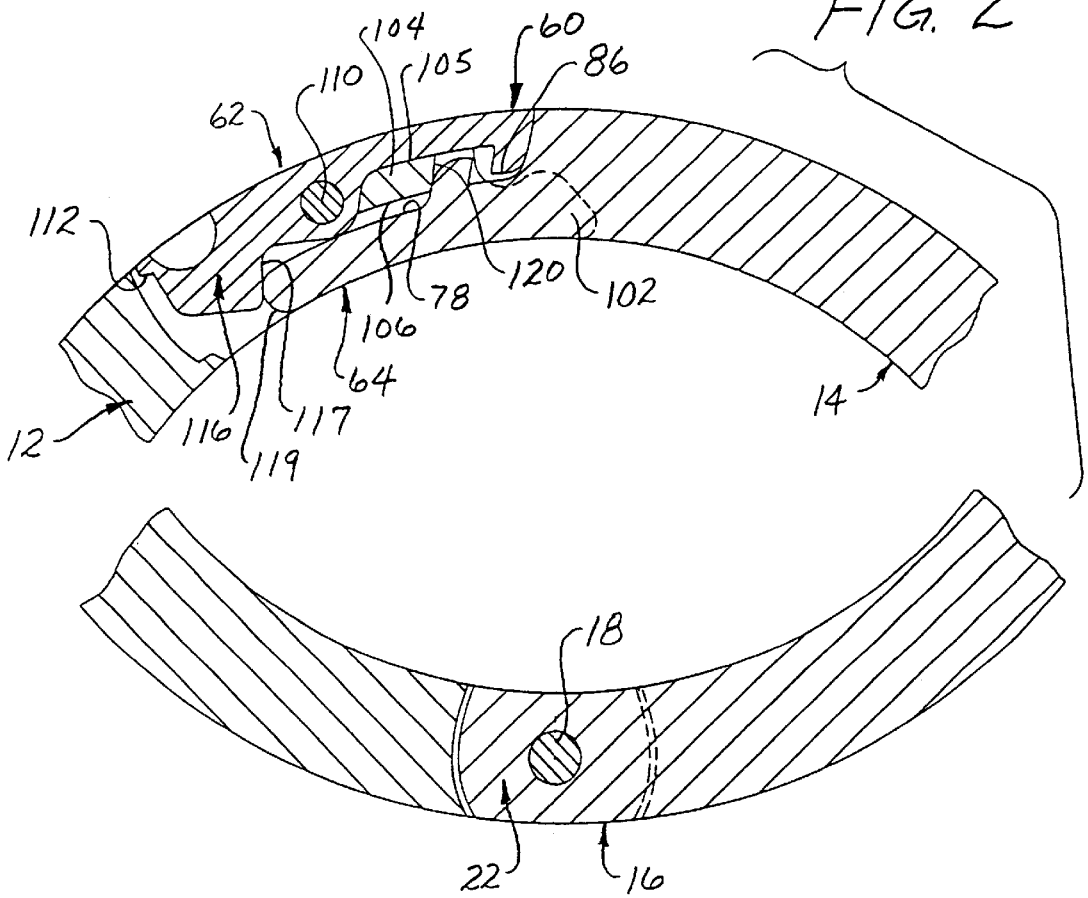
FIG. 2 is a fragmentary sectional view taken along line 2—2 showing the arrangement of the openable ring having unique cooperating tongue and groove members of the invention in the closed position.
Figure 3:
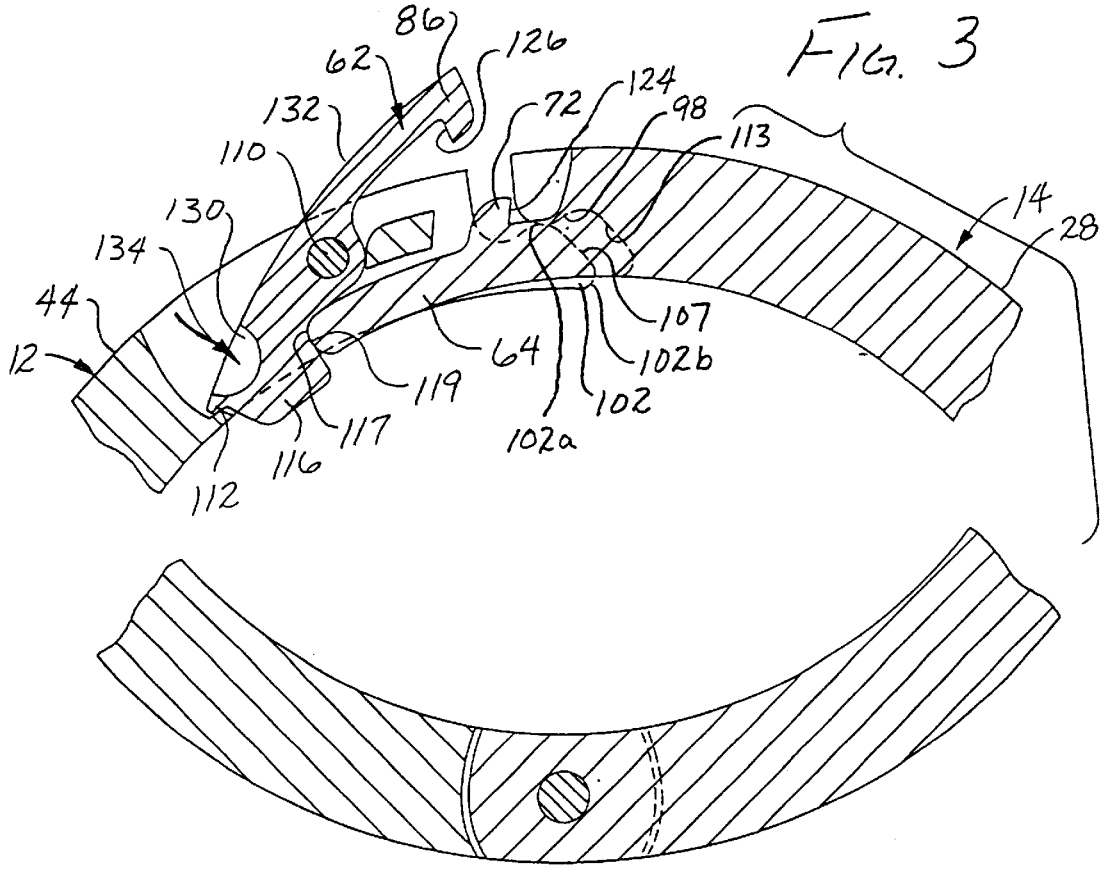
FIG. 3 is a sectional view similar to FIG. 2, but showing the arrangement of the openable ring having unique cooperating tongue and groove members after the latch mechanism has been depressed to open the arcuate sections; and, FIG. 4 is a fragmentary, exploded isometric view showing details of the latch mechanism having unique cooperating tongue and groove members of this invention.
Figure 4:
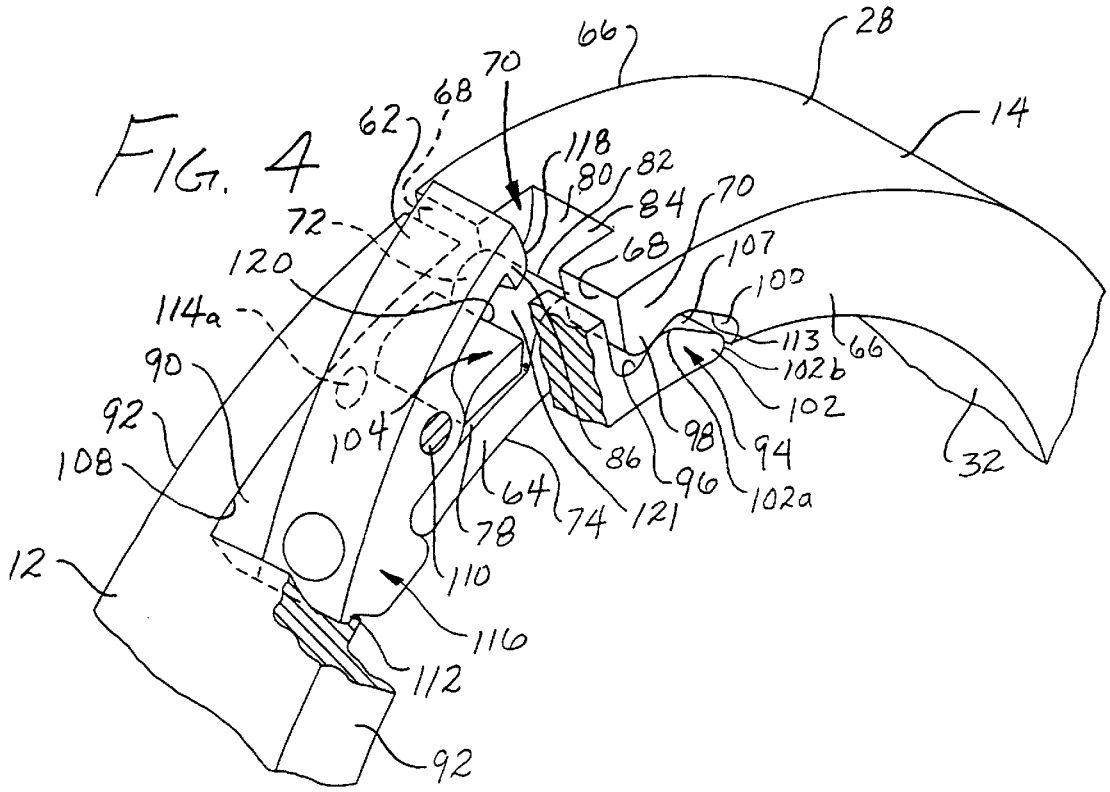

Referring to FIGS. 2, 3 and 4, the latch mechanism 60 includes a safety latch 62 which is automatically moved into a locked position as the ring is moved into a closed position. The safety latch 62 also functions as a release mechanism for assisting in the opening of the ring, when it is desired to remove the ring from a person's finger.

As will be explained in greater detail hereinafter, the latch mechanism 60 employs a joint arrangement to maximize resistance against bending stresses, without the use of separate spring members. The latch mechanism 60 of this invention relies for its operation on the inherent spring tension within each of the arcuate sections 12 and 14; not upon the use of separate spring members which may fail in operation and which can add additional fabrication and material costs to the ring.

As can be seen best in FIG. 4, the latch mechanism 60 includes an elongate tongue 64 located centrally between sidewalls 66 of the arcuate ring section 14. The tongue 64 extends distally beyond end walls 68 of shorter, tongue and groove locking extensions 70 that straddle the tongue 64.

Still referring to FIG. 4 the tongue 64 has a raised shoulder 72 adjacent a proximal end thereof. The inner surface 74 of the tongue has substantially the same radius of curvature as inner surface 32 of the ring section 14, to thereby provide a substantially continuous smooth extension of said inner surface 32. Since the tongue 64 is not as thick as the main body of the ring section 14, its outer surface 78 is spaced inwardly of the outer surface 28 of the main body of said ring section.

Referring to FIG. 4, a transition surface 80, constituting the proximal end of the outer surface 78 of the tongue, actually meets with the outer surface 28 of the main body portion of the ring section 14. A proximally facing surface 82 (FIG. 4) of the shoulder 72 cooperates with the transition surface 80 to provide a recessed region 84 into which an inwardly directed nib 86 at the distal end of the safety latch 62 seats, when the ring is in a closed and locked condition (FIG. 2).

Referring to FIG. 4, the distal end of the ring section 12, includes a generally U-shaped recess 90 located centrally between outer side surfaces 92, to thereby provide transversely spaced-apart, tongue and groove locking extensions 94. These locking extensions are aligned to cooperate with the locking extensions 70 provided on a contiguous end of the arcuate ring section 14 in a manner to be described below in accordance with the present invention.

Still referring to FIG. 4, each of the locking extensions 94 of arcuate section 12 includes an outwardly facing groove 96, which cooperates and lockingly engages with an inwardly facing tongue 98 of a cooperating locking extensions 70 forming part of the arcuate section 14. In addition, an inwardly facing groove 100 located on each of the locking extensions 70, at a location rearward or proximally of the inwardly facing tongue 98, lockingly engages with an outwardly facing tongue 102 of a cooperating locking extension 94, when the ring is in a closed position.

As stated above, in U.S. Pat. No. 5,136,858, where the thickness of the ring is relatively small, e.g., approximately 2.0 millimeters in thickness and 2.5 millimeters wide, only a small amount of force is required to flex the arcuate sections slightly to permit the tongues of the opposed locking extensions to ride over each other and snap into their respective grooves to move the ring to the closed position. Where thickness is relatively small, the fact that the tongues of the opposed locking extensions are "bulbous" in shape will not serve as an impediment to moving the ring to the closed position. Likewise, the grooves, arranged for receiving the tongues once they have rode over each other, may also be rounded in shape. The bulbous shape of the tongues of the '858 patent are best illustrated at 98 and 102 of FIG. 4 of the '858 patent. The rounded shape of the respective grooves of the '858 patent are also best illustrated at 96 and 100 of FIG. 4 of the '858 patent.

Where the thickness of the ring is somewhat greater, e.g., between approximately 6 and 8 millimeters, a great deal more force is required to engage the locking extensions on one arcuate section with the locking extensions on the other arcuate section. Openable rings constructed in accordance with the '858 patent and having somewhat greater thicknesses may be considerably more difficult to close.

Referring now to FIGS. 3 and 4, to ease the difficulty in closing such rings having greater thicknesses, rather than being rounded in shape, each outward facing tongue 102 is elongated in shape to include a top rounded edge 102*a* and a distal rounded edge 102*b* and a slightly inclined ramp section 107 located therebetween. Top rounded edge 102*a* can be of any suitable radius of curvature, e.g., 0.020 inches. Likewise, distal rounded edge 102*b* can be of any suitable radius of curvature, e.g., 0.012 inches. As best shown in the figures, the ramp section 107 is substantially flat over its length and inclines gradually. Likewise, rather than being rounded in shape, each inwardly facing groove 100 is complementary in shape to each tongue 102 and includes a substantially flat and slightly sloping section 113. The cooperative, locking engagement between the grooves 96 and tongues 102 of locking extensions 94, with complimentary shaped tongues 98 and grooves 100 of the locking extensions 70, takes place by a "snap action." Due to the inclusion of the slightly inclined ramp section 107 on the tongues 102, less force is required for engaging these locking extensions. Specifically, when compressive force is applied to the arcuate sections 12 and. 14, the bulbous tongues 98 are caused to gradually ride up the long linear distance of the inclined ramp section 107 of the elongated tongues 102. Due to the gradual inclining nature of the ramp section 107, less force is required for the bulbous tongues 98 to ride over the elongated tongues 102 to obtain this snap action. Under the '858 patent, because the tongues 98 and 102 are both "bulbous" in shape, they ride over each other in a shorter distance that is more abrupt, thus requiring more force to achieve engagement of the locking extensions 70 and 94.

The difficulty in closing such rings having greater thicknesses is substantially reduced because of the gradual inclining ramp section 107 of the tongues 102. It should be noted that with the ring in a closed condition the confronting surfaces of grooves 96 and tongues 98, and the confronting surfaces of grooves 100 and tongues 102 are in engagement with each other to provide smooth, aesthetically pleasing outer side surfaces of the ring 10 (see FIGS. 1 and 2). In accordance with the present invention, the preferred embodiment as shown in FIG. 1 may of any suitable inner diameter, e.g., between approximately 0.586 inches and approximately 0.938 inches; may be of any suitable thickness, e.g., between approximately 2.0 millimeters and 4.0 millimeters, and, may be of any, suitable width, e.g., between 4 and 10 millimeters.

Referring to FIGS. 2 and 4, a transversely extending bridge section 104 constitutes a part of the latch mechanism 60 and is unitarily formed between the locking extensions 94 of the arcuate section 12. This bridge section adds rigidity to the system, by actually-providing a brace between the locking extensions. In addition, as can be seen best in FIG. 2, an upper surface 105 of the bridge section provides a support for the safety latch 62 when the safety latch is in a ring-locking position.

As can be seen best in FIG. 2, the bridge section 104 also includes a lower surface 106. This lower surface, in conjunction with inner side surfaces of the recess 90 define a channel for receiving the elongate tongue 64 therein (see FIG. 4). In addition, it should be noted that the lower surface 106 of the bridge section is spaced from the upper surface 78 of the elongate tongue 64 when the ring is in a closed position. The location of the bridge section 104 and tongue 64 to provide this spacing is required, to thereby permit relative radial movement to take place between the arcuate sections 12 and 14, for permitting the grooves 96 and tongues 102 of locking extensions 94 to "snap" into locking engagement with complementary shaped tongues 98 and grooves 100, respectively, of the locking extensions 70. Since the space between the lower surface 106 of the bridge section and the upper surface 78 of the tongue 64 is located in the interior of the ring, it is not visible, and therefore does not detract from the aesthetically pleasing appearance of the ring construction.

Referring to FIGS. 2 and 4, a pivot pin 110 of the safety latch 62 is located intermediate the inwardly directed nib 86 at the distal end of the latch, and an inwardly directed shoulder 112 of a nib located at the proximal end of the latch. The pivot pin 110 extends through an opening (not shown) provided through one of the tongue and groove extensions 94, and into an aligned, blind opening 114*a* extending only partially through the other of said extensions, from the inner side surface 108 thereof (FIG. 4). Thus, an end surface of the pivot pin 110 is only visible from one side of the ring, and the base of the blind opening 114*a* provides a surface for properly locating the pin relative to the other components of the ring.

Referring to FIGS. 2 and 4, the safety latch 62 includes an inwardly projection section 116 adjacent the proximal end 112 thereof. This inwardly projecting section includes a generally distally facing surface 117 that cooperates with distal end 119 of the tongue 64, to automatically pivot the safety latch 62 in a clockwise direction, as viewed in FIG. 2, into the closed and locked position shown in FIG. 2.

Specifically, as the ring 10 is moved from its opened position, as is seen best in FIGS. 3 and 4, into the closed position shown in FIG. 2, the distal end 119 of the tongue 64 engages the surface 117 of inwardly projecting section 116, causing the safety latch to rotate in a clockwise direction. Continuous movement of the ring sections into a closed position imposes a slight inwardly radial force on the tongue 64, causing the inherent spring tension within the tongue to impose an opposite, outward radial force on the inwardly projecting section 116 of the safety latch 62. In view of the fact that the inwardly projecting section 116 is located to the left of the pivot pin 110, as is viewed in FIGS. 2 and 3, this outward, radial force maintains the safety latch 62 in its locked condition. As shown in FIG. 4, in this locked condition distal surface 118 of the safety latch 62 is biased into a position closely adjacent the transition surface 80 located proximal of the shoulder 72 of the tongue 64. This provides a generally aesthetically pleasing outer surface appearance, and generally eliminates exposed edge surfaces to irritate the finger adjacent the ring finger.

In the closed position of the latch 62, distally-facing surface 120 of the bridge section 104 is contiguous to a distally-facing surface segment 121 of the raised shoulders 72. In fact, in the preferred construction, the spacing between these latter surfaces 120, 121 is on the order of 0.002 inches.

It should be noted that the force biasing the safety latch into a closed position, resulting from the engagement of tongue 64 with the projecting section 116, is continuously maintained during a portion of the counterclockwise rotational movement of the safety latch in the direction of arrow 134 (FIG. 3). This arrangement precludes inadvertent opening of the safety latch 62, in that any slight, inadvertent, counterclockwise movement of the safety latch, in the direction of arrow 134, will not automatically open the safety latch. In fact, once the pressure or force is released, the normal spring tension imposed upon the projecting section 116, by the tongue 64 will automatically snap the safety latch back into its locking position. In other words, the cam arrangement provided by the interaction of the tongue 64 with the projection 116 will trigger an opening action at a depth of counterclockwise rotation, which only can be reached by the use of a separate implement, such as a pen or pencil, as will be described hereinafter.

Referring to FIGS. 2 and 3, when the safety latch 62 is in a closed condition a proximal-facing surface 124 of raised shoulder 72 of the tongue 64 is in radial overlapping relationship with a proximal-facing surface 126 of the inwardly directed nib 86 of the safety latch 62. The inherent spring tension of tongue 64 biases the safety latch 62 into a position wherein the radially overlapping surfaces 124, 126 are circumferentially spaced from each other. However, in the event that some of the "springiness" of the tongue 64 becomes degraded, thereby permitting some separation of the arcuate sections 12 and 14, the overlapping surfaces 124, 126 will engage each other, to thereby preclude the inadvertent, complete opening of the ring sections.

Although the safety latch 62 provides an extremely reliable locking function, the safety latch is capable of automatically moving into an opened position, in the event that any excessively high, abrupt, pulling force or pressure is imposed upon the ring, to thereby prevent serious injury to the wearer's finger. In fact, the sudden surge of a pulling force or pressure will trigger an opening of the ring, like a safety fuse that explodes under a surge of excess energy.

Referring specifically to FIG. 3, the proximal end 112 of the safety latch 62 includes a small diameter recess 130 provided in outer surface 132 thereof. This small diameter recess is adapted to receive a small instrument (e.g., the point of a pen or pencil) therein, to provide a counterclockwise latch opening force on the safety latch 62, in the direction of arrow 134, as viewed in FIG. 3.

Referring to FIG. 3, it should be noted that the outer surface 132 of the safety latch 62 has a radius of curvature generally corresponding to the radius of curvature of the outer surfaces 44 and 28 of arcuate sections 12 and 14, to thereby provide, in cooperation with the arcuate sections, a substantially continuous curved outer surface when the ring is closed.

Referring to FIG. 3, proximally facing surface 117 of the inwardly projecting section 116 engages the distal end 119 of tongue 64, to thereby force the tongue in a direction to the right (as viewed in FIG. 3) for partially disengaging the tongue and groove interconnection between the locking extensions 70 on arcuate section 14, on the one hand, and locking extensions 94 on the arcuate section 12, on the other hand. This separated condition of locking extensions is illustrated in both FIG. 3, with the inwardly facing surfaces of tongues 98 engaging the outwardly facing surfaces of tongues 102. Thereafter, the arcuate sections can be easily gripped by the wearer of the ring to complete the ring-opening operation.

I claim:

1. An openable ring arranged to be worn about a portion of a body of a person and requiring less closing force, said ling comprising:

a. first and second arcuate sections pivotally interconnected at one end of said ring for permitting pivotal movement of said arcuate sections between opened and closed positions, said arcuate sections also having an end opposite the pivotal interconnection;

b. at least one locking extension disposed on each arcuate section at the end opposite the pivotal interconnection, each said locking extension provided for cooperating with a locking extension of the other arcuate section for releasably retaining the arcuate sections in a closed position, said arcuate sections, in a closed position, defining a closed ring having an inner surface defining an interior passage for receiving said portion of a body of a person and an outer surface;

c. each locking extension on the first arcuate section being transversely aligned with a respective locking extension on said second arcuate section;

d. each locking extension on said first arcuate section including male and female connecting sections, each said male connecting section further including an inclined ramp section having a top rounded edge;

e. each locking extension on said second arcuate section including male and female connecting sections; and, f. in response to movement of the arcuate sections towards the closed position, each said male connecting section of said second arcuate section riding up said inclined ramp section and over a corresponding male connecting section of said first arcuate section thus causing said first and second arcuate sections to be releasably retained in said closed position wherein said male and female connecting sections of said locking extensions of said first arcuate section interlock with said male and female connecting sections of said transversely aligned locking extensions of said second arcuate sections provide smooth, aesthetically pleasing outer side surfaces of said ring.

2. The openable ring of claim 1 wherein each said ramp section is integral with each said male connecting section of said first arcuate section.

3. The openable ring of claim 1 wherein said male and female connecting sections on said first arcuate section face outwardly.

4. The openable ring of claim 3 wherein each said inclined ramp section of said first arcuate section faces outwardly.

5. The openable ring of claim 4 wherein said male and female connecting sections on said second arcuate section face inwardly.

6. The openable ring of claim 1 wherein each said inclined ramp section of said first arcuate section is substantially flat over its length.

7. The openable ring of claim 1 wherein the thickness of said ring is between approximately 2 and 4 millimeters and the width is between 4 and 10 millimeters.

8. The openable ring of claim 1 wherein said ring is made of a precious metal.

9. The openable ring of claim 1 wherein said ring is made of gold.

10. The openable ring of claim 1 wherein the inner diameter of said ring is between approximately 0.586 inches and approximately 0.938 inches.

11. The openable ring of claim 1 wherein said closed position is non-adjustable preventing any further movement of said arcuate sections past said closed position.

* * * * *